US010486042B1

(12) United States Patent
Frederickson

(10) Patent No.: US 10,486,042 B1
(45) Date of Patent: Nov. 26, 2019

(54) GOLF CLUB HEAD WITH ADJUSTABLE CENTER OF GRAVITY

(71) Applicant: Callaway Golf Company, Carlsbad, CA (US)

(72) Inventor: Austin L. Frederickson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/403,811

(22) Filed: May 6, 2019

Related U.S. Application Data

(60) Provisional application No. 62/673,024, filed on May 17, 2018.

(51) Int. Cl.
*A63B 60/04* (2015.01)
*A63B 53/06* (2015.01)
*A63B 53/04* (2015.01)

(52) U.S. Cl.
CPC ..... *A63B 60/04* (2015.10); *A63B 53/06* (2013.01); *A63B 2053/0433* (2013.01); *A63B 2053/0491* (2013.01)

(58) Field of Classification Search
CPC . A63B 60/04; A63B 53/06; A63B 2053/0433; A63B 2053/0491
USPC ..... 473/324–350, 287–292, 256
See application file for complete search history.

(56) References Cited

U.S. PATENT DOCUMENTS 2,098,445 A * 11/1937 Wettlaufer ..... A63B 53/04 473/333
2,171,383 A * 8/1939 Wettlaufer ..... A63B 53/08 473/335
3,199,874 A * 8/1965 Blasing ..... A63B 49/00 473/244
4,073,492 A * 2/1978 Taylor ..... A63B 53/007 473/246
5,511,779 A * 4/1996 Meyers ..... A63B 53/065 473/246
5,683,309 A * 11/1997 Reimers ..... A63B 53/04 473/337
5,788,587 A * 8/1998 Tseng ..... A63B 53/04 473/326
5,916,042 A * 6/1999 Reimers ..... A63B 53/04 473/334
6,244,976 B1 * 6/2001 Murphy ..... A63B 53/04 473/305
6,332,847 B2 * 12/2001 Murphy ..... A63B 53/04 473/324
6,386,990 B1 * 5/2002 Reyes ..... A63B 53/02 473/344
6,406,378 B1 * 6/2002 Murphy ..... A63B 53/04 473/224
6,440,008 B2 * 8/2002 Murphy ..... A63B 53/04 473/324

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head having an adjustable assembly comprising a weight arm that is at least partially suspended within an interior cavity of the body of the golf club head is disclosed herein. The weight arm, which comprises a bar with a weighted portion affixed to one end of the bar, can be moved within the interior cavity to change the golf club head center of gravity, thereby adjusting the bias of the club head.

18 Claims, 13 Drawing Sheets

(56) References Cited

U.S. PATENT DOCUMENTS 6,443,855 B1 * 9/2002 Tseng ..... A63B 53/0466 473/326
6,471,604 B2 * 10/2002 Hocknell ..... A63B 53/02 473/334
6,478,692 B2 * 11/2002 Kosmatka ..... A63B 53/04 473/342
6,491,592 B2 * 12/2002 Cackett ..... A63B 53/02 473/342
6,508,978 B1 * 1/2003 Deshmukh ..... A63B 53/04 419/5
6,514,154 B1 * 2/2003 Finn ..... A63B 53/02 473/306
6,527,650 B2 * 3/2003 Reyes ..... A63B 53/02 473/345
6,565,452 B2 * 5/2003 Helmstetter ..... A63B 53/02 473/342
6,575,845 B2 * 6/2003 Galloway ..... A63B 53/02 473/329
6,582,323 B2 * 6/2003 Soracco ..... A63B 53/02 473/342
6,592,466 B2 * 7/2003 Helmstetter ..... A63B 53/04 473/224
6,602,149 B1 * 8/2003 Jacobson ..... A63B 53/04 473/329
6,607,452 B2 * 8/2003 Helmstetter ..... A63B 53/02 473/345
6,663,504 B2 * 12/2003 Hocknell ..... A63B 53/02 473/329
6,669,578 B1 * 12/2003 Evans ..... A63B 53/0466 473/342
6,739,982 B2 * 5/2004 Murphy ..... A63B 53/02 473/342
6,758,763 B2 * 7/2004 Murphy ..... A63B 53/02 473/342
6,860,824 B2 * 3/2005 Evans ..... A63B 53/0466 473/342
6,994,637 B2 * 2/2006 Murphy ..... A63B 53/02 473/345
7,025,692 B2 * 4/2006 Erickson ..... A63B 53/0466 473/335
7,070,517 B2 * 7/2006 Cackett ..... A63B 53/0466 473/342
7,108,609 B2 * 9/2006 Stites ..... A63B 53/06 473/256
7,112,148 B2 * 9/2006 Deshmukh ..... A63B 53/04 473/342
7,118,493 B2 * 10/2006 Galloway ..... A63B 53/02 473/329
7,121,957 B2 * 10/2006 Hocknell ..... A63B 53/02 473/342
7,125,344 B2 * 10/2006 Hocknell ..... A63B 53/02 473/345
7,128,661 B2 * 10/2006 Soracco ..... A63B 53/02 473/329
7,163,470 B2 * 1/2007 Galloway ..... A63B 53/0466 473/342
7,226,366 B2 * 6/2007 Galloway ..... A63B 53/0466 473/332
7,252,600 B2 * 8/2007 Murphy ..... A63B 53/02 473/345
7,258,631 B2 * 8/2007 Galloway ..... A63B 53/0466 473/345
7,314,418 B2 * 1/2008 Galloway ..... A63B 53/0466 473/345
7,320,646 B2 * 1/2008 Galloway ..... A63B 53/02 473/224
7,387,577 B2 * 6/2008 Murphy ..... A63B 53/02 473/305
7,396,296 B2 * 7/2008 Evans ..... A63B 53/0466 473/344
7,402,112 B2 * 7/2008 Galloway ..... A63B 53/02 473/224
7,407,448 B2 * 8/2008 Stevens ..... A63B 53/02 473/329
7,413,520 B1 * 8/2008 Hocknell ..... A63B 53/0466 473/345
7,431,667 B2 * 10/2008 Vincent ..... A63B 53/0466 473/345
7,438,647 B1 * 10/2008 Hocknell ..... A63B 53/0466 473/334
7,455,598 B2 * 11/2008 Williams ..... A63B 53/02 473/329
7,476,161 B2 * 1/2009 Williams ..... A63B 53/02 473/329
7,491,134 B2 * 2/2009 Murphy ..... A63B 53/0466 473/329
7,497,787 B2 * 3/2009 Murphy ..... A63B 53/0466 473/329
7,549,935 B2 * 6/2009 Foster ..... A63B 53/0466 473/335
7,578,751 B2 * 8/2009 Williams ..... A63B 53/02 473/329
7,717,807 B2 * 5/2010 Evans ..... A63B 53/0466 473/344
7,749,096 B2 * 7/2010 Gibbs ..... A63B 53/02 473/329
7,749,097 B2 * 7/2010 Foster ..... A63B 53/0466 473/329
7,927,231 B2 * 4/2011 Sato ..... A63B 53/0466 473/334
8,002,644 B2 * 8/2011 Hocknell ..... A63B 53/00 473/288
8,684,859 B1 * 4/2014 Aguinaldo ..... A63B 53/06 473/307
8,696,486 B1 * 4/2014 Aguinaldo ..... A63B 53/0466 473/307
8,715,102 B1 * 5/2014 Aguinaldo ..... A63B 53/06 473/307
8,715,103 B1 * 5/2014 Aguinaldo ..... A63B 53/06 473/307
8,715,104 B1 * 5/2014 Wall, Jr. ..... A63B 53/06 473/309
8,727,906 B1 * 5/2014 Aguinaldo ..... A63B 53/02 473/307
8,790,195 B1 * 7/2014 Myers ..... A63B 53/0466 473/338
8,801,537 B1 * 8/2014 Seluga ..... A63B 53/06 473/307
8,968,116 B1 * 3/2015 Myers ..... A63B 53/0466 473/338
8,992,339 B2 * 3/2015 Matsunaga ..... A63B 53/04 473/335
9,597,561 B1 * 3/2017 Seluga ..... A63B 53/06
9,687,701 B1 * 6/2017 Seluga ..... A63B 53/0466
9,687,702 B1 * 6/2017 Seluga ..... A63B 53/0466
9,694,257 B1 * 7/2017 Seluga ..... A63B 53/0475
9,757,629 B2 * 9/2017 Seluga ..... A63B 53/0466
9,776,058 B2 * 10/2017 Seluga ..... A63B 53/0466
9,814,947 B1 * 11/2017 Seluga ..... A63B 53/0466
9,821,199 B1 * 11/2017 Seluga ..... A63B 53/0466
9,855,476 B2 * 1/2018 Seluga ..... A63B 53/0466
9,908,016 B2 * 3/2018 Seluga ..... A63B 53/0466
9,908,017 B2 * 3/2018 Seluga ..... A63B 53/0466
9,931,549 B1 * 4/2018 Seluga ..... A63B 53/0466
9,931,550 B1 * 4/2018 Seluga ..... B22C 9/24
9,987,535 B2 6/2018 Kline et al.
2006/0240907 A1 * 10/2006 Latiri ..... A63B 53/0466 473/334
2010/0331103 A1 * 12/2010 Takahashi ..... A63B 53/0466 473/338
2017/0036081 A1 2/2017 Kline et al.

* cited by examiner

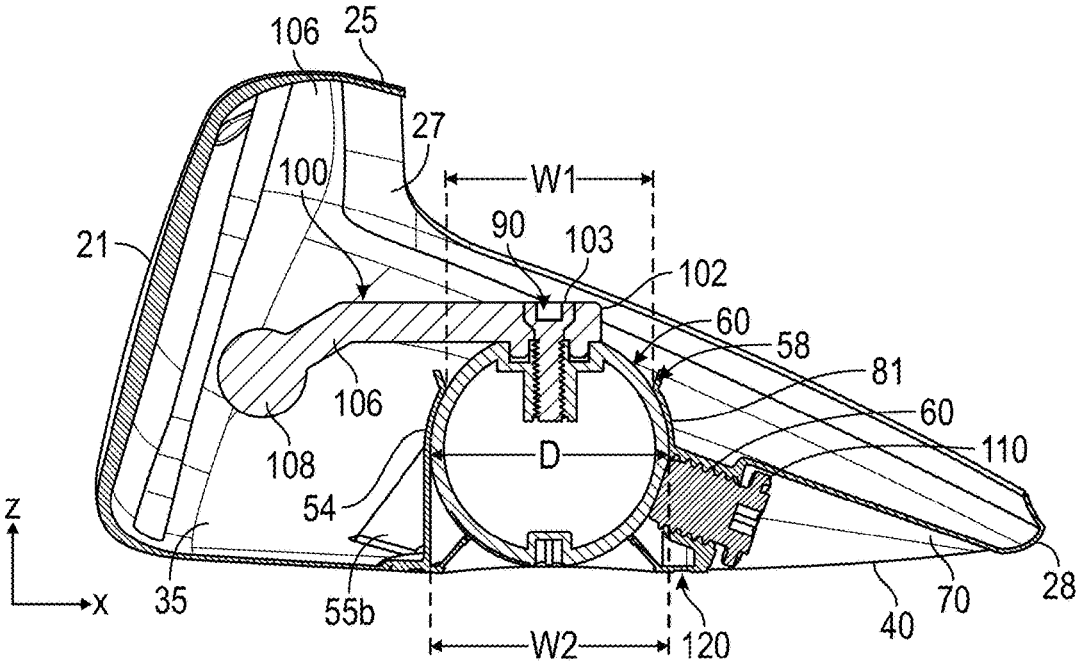
FIG. 7
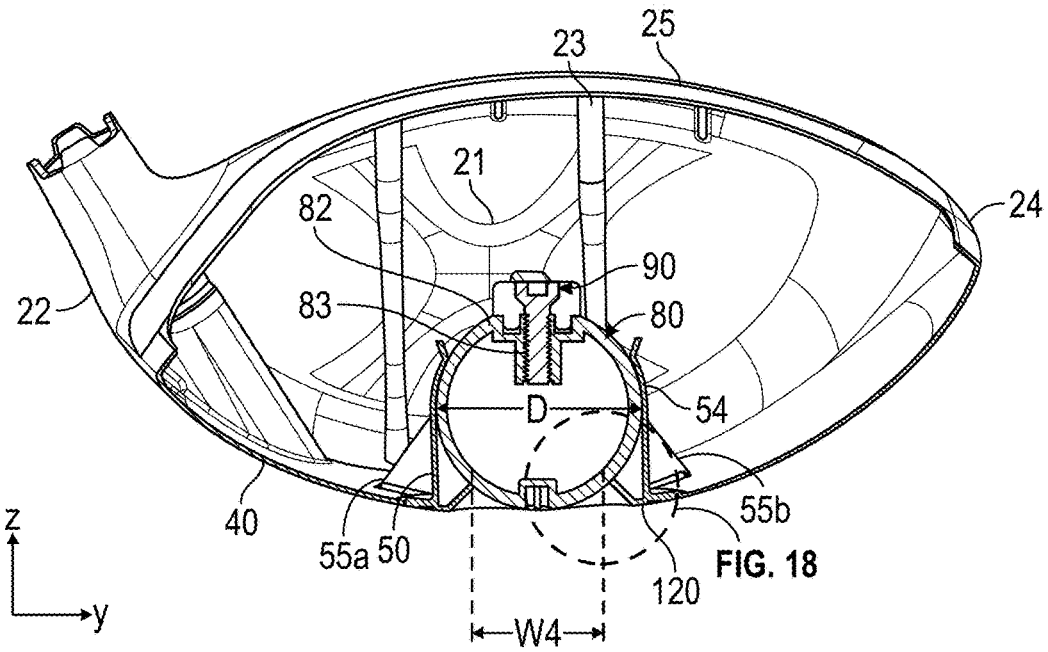
FIG. 18
FIG. 8

GOLF CLUB HEAD WITH ADJUSTABLE CENTER OF GRAVITY

CROSS REFERENCES TO RELATED APPLICATIONS

The present application claims priority to U.S. Provisional Patent Application No. 62/673,024, filed on May 17, 2018, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with an internal weight that can be adjusted along all three dimensional axes.

Description of the Related Art

The ability to adjust center of gravity location and weight in the head of driving clubs is useful for controlling performance of the golf club. The prior art includes several different solutions for adjustable weighting, but these solutions do not optimize weight adjustment along all three x, y, and z axes via a single weight assembly. There is therefore a need for a weighting mechanism that allows for simple and flexible center of gravity (CG) and moment of inertia (MOI) adjustability.

BRIEF SUMMARY OF THE INVENTION

The present invention is directed to a novel way of working with adjustable sporting good products. In particular, the present invention allows a user to adjust the center of gravity of a golf club head along all three axes (a horizontal x axis extending through a face geometric center, a horizontal heel-toe y axis extending perpendicular to the x axis, and a vertical z axis extending perpendicular to both x and y axes) using a single tool to adjust a single weight assembly. The weight assembly can be adjusted by near-infinite increments to fine tune the golf club head center of gravity.

The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature that allows for lateral and vertical center of gravity control, is placed to maximize effectiveness, and may be entirely concealed from view at address.

One aspect of the present invention is a golf club head comprising a body comprising a face portion, a sole, a crown, a heel side, a toe side, a rear side, a port, and an interior cavity, an adjustment sphere comprising an upper end and a lower end opposite the upper end, a weight arm comprising a first end, a midsection, and a second end having a weight portion and a retention device capable of extending into the port, wherein the port comprises a port wall, an interior opening having a first width in communication with the interior cavity, and an exterior opening having a second width that is greater than the first width, wherein the adjustment sphere is at least partially disposed within the port so that the upper end is exposed to the interior cavity through the interior opening and the lower end is visible through the exterior opening, wherein the adjustment sphere has a diameter that is greater than the first width and less than the second width, wherein the first end of the weight arm is affixed to the upper end of the adjustment sphere, wherein at least the second end of the weight arm is suspended within the interior cavity and does not make direct contact with the body, wherein moving the adjustment sphere within the port causes the weight arm to move within the interior cavity and thereby change at least one of a moment of inertia and a location of a center of gravity of the golf club head, and wherein engaging the retention device reversibly immobilizes the adjustment sphere within the port.

In some embodiments, the golf club head may further comprise an adjustment ring having a cover and a through-opening. The adjustment ring may be affixed to the sole so that a portion of the adjustment ring extends over the exterior opening of the port and the lower end of the adjustment sphere is visible through the through-opening. In a further embodiment, the adjustment ring may further comprise a conical portion and a gasket, the conical portion may extend from the cover into the port, and the gasket may be attached to an edge of the cover and contact the adjustment sphere. In another embodiment, each of the lower end of the adjustment sphere and an outer surface of the cover may comprise at least one alignment marking.

In other embodiments, the weight portion may be composed of a first material having a first density, and at least one of the first end and midsection of the weight arm may be composed of a second material having a second density that is less than the first density. In further embodiments, the first material may be a tungsten alloy, and the second material may be selected from the group consisting of composite, plastic, aluminum alloy, and steel. In still other embodiments, the weight portion may be spherical.

In still other embodiments, the adjustment sphere may be hollow and be composed of a material selected from the group consisting of composite, plastic, aluminum alloy, and steel. In other embodiments, at least one of the first end and midsection of the weight arm may have a hollow portion. In yet another embodiment, the golf club head may comprise a threaded through-bore extending through the port wall. The threaded through-bore may be accessible from outside of the body, and the retention device may be a friction screw having a second threaded portion sized to mate with threads of the threaded through-bore, such that tightening the friction screw within the threaded through-bore causes the second threaded portion to press against the adjustment sphere.

In still other embodiments, the lower end of the adjustment sphere may comprise a tool engagement opening. In another embodiment, the retention device may be selected from the group consisting of a friction screw, a cam assembly, and a threaded cap. In still other embodiments, the golf club head may further comprise at least one rib, the port may be disposed in the sole, and the at least one rib may extend between an interior surface of the sole and the port wall. In yet another embodiment, the port may comprise a port flange surrounding the interior opening, and the port flange may extend at an angle with respect to the port wall.

Another aspect of the present invention is a golf club head comprising a metal body comprising a face, a return portion extending from an upper edge of the face, a sole extending from a lower edge of the face, a port extending from the sole into an interior cavity, a sole channel, and an upper opening, a non-metal crown affixed to the body to cover the upper opening and enclose the interior cavity, a hollow adjustment sphere comprising an upper end having a threaded bore, a first shallow recess encircling the threaded bore, and at least one locating divot, and a lower end opposite the upper end having at least one tool engagement feature, a weight arm comprising a first end with a through opening, at least one locating pin, and a flange encircling the through opening, an elongated midsection, and a second end affixed to a spherical weight portion, a fastener comprising a first head portion and a first threaded portion; and a friction screw comprising a second threaded portion, wherein the port comprises a wall, an interior opening with a first width in communication with the interior cavity, an exterior opening with a second width that is greater than the first width, and a threaded through-bore that extends through the wall and communicates with the sole channel, wherein the adjustment sphere is disposed within the port so that the upper end is exposed to the interior cavity through the interior opening and the lower end is visible through the exterior opening, wherein the first end of the weight arm is disposed within the first shallow recess so that the through opening aligns with the threaded bore of the adjustment sphere and the at least one locating pin is disposed within the at least one locating divot, wherein the first threaded portion extends through the through opening to engage the threads of the threaded bore and the first head portion abuts the flange, thereby affixing the weight arm to the adjustment sphere, wherein the midsection and the second end of the weight arm are suspended within the interior cavity, wherein the second threaded portion of the friction screw extends through the through-bore and into the port, wherein moving the adjustment sphere within the port causes the weight arm to move within the interior cavity and thereby change at least one of a moment of inertia and a location of a center of gravity of the golf club head, and wherein tightening the friction screw causes the second threaded portion to press against the adjustment sphere and reversibly immobilize the adjustment sphere within the port.

In some embodiments, the port may further comprise a port flange surrounding the interior opening, and the port flange may extend at an angle with respect to the port wall. In other embodiments, the sole channel may extend from a rear edge of the body towards the port. In still other embodiments, the spherical weight portion may composed of a tungsten alloy, and at least one of the first end and midsection of the weight arm may be composed of a material selected from the group consisting of composite, plastic, aluminum alloy, and steel. In any of these embodiments, the golf club head may be selected from the group consisting of a driver-type head, a fairway wood-type head, and a hybrid-type head.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is an enlarged view of the circled portion of the embodiment shown in

FIG. 2.

FIG. 7 is a cross-sectional view of the embodiment shown in FIG. 4 along lines 7-7.

FIG. 8 is a cross-sectional view of the embodiment shown in FIG. 4 along lines 8-8.

DETAILED DESCRIPTION OF THE INVENTION

Figure 1:
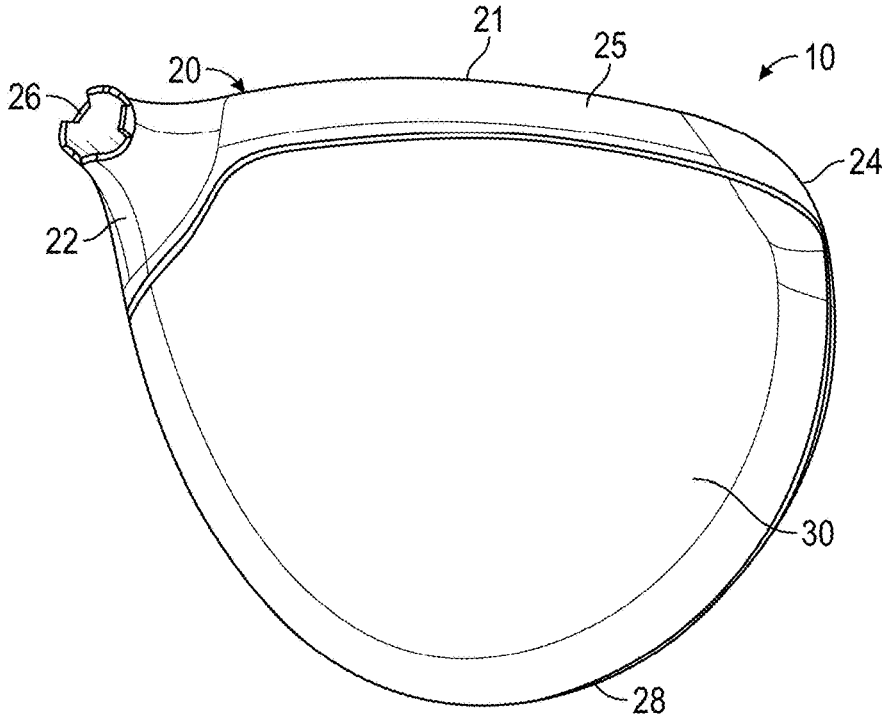
FIG. 1 is a top plan view of a golf club head of the present invention.
Figure 2:
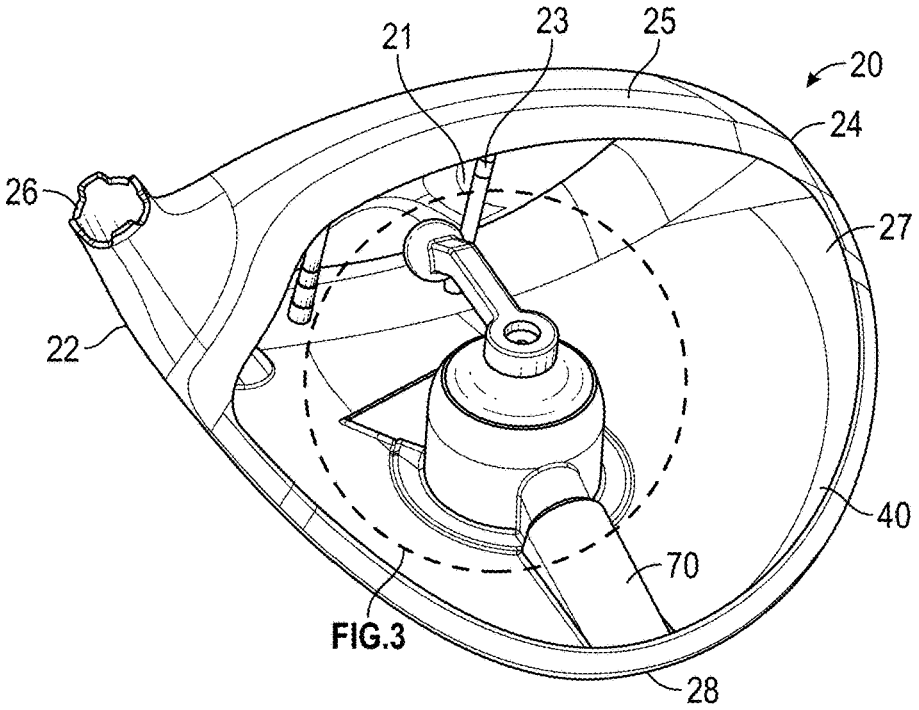
FIG. 2 is a top, perspective view of the golf club head shown in FIG. 1 with the crown section removed.
Figure 3:
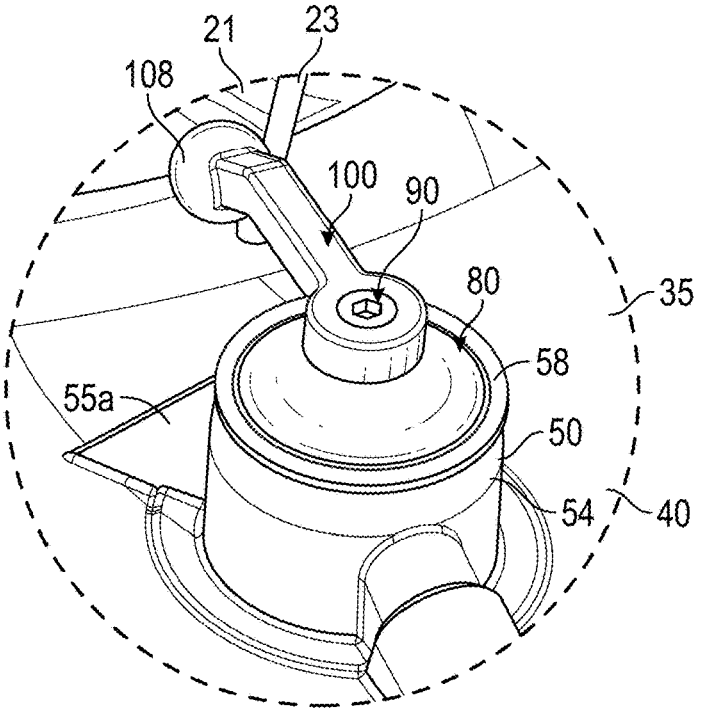
Figure 4:
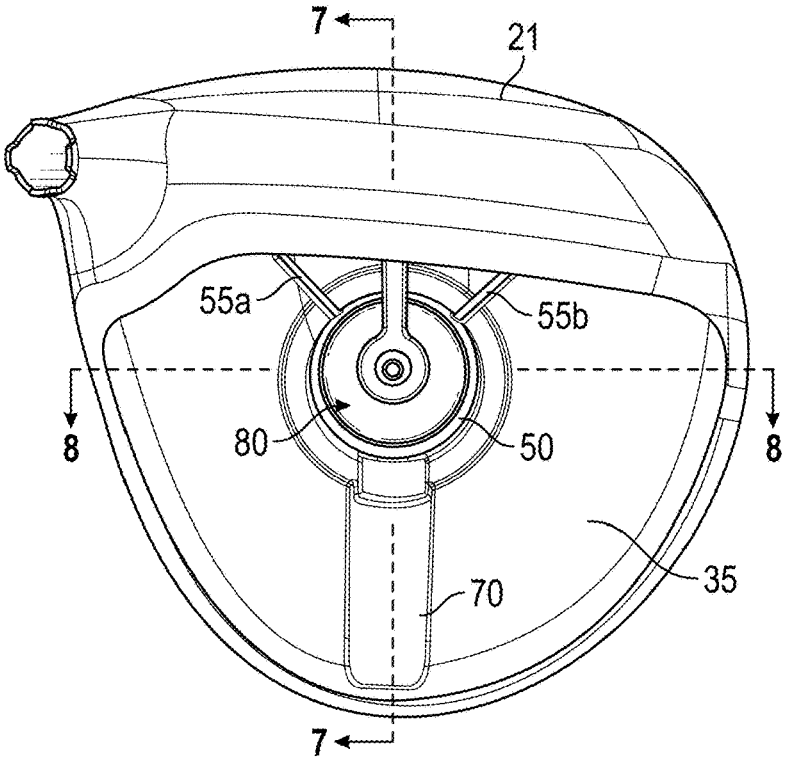
FIG. 4 is a top plan view of the embodiment shown in FIG. 2.
Figure 5:
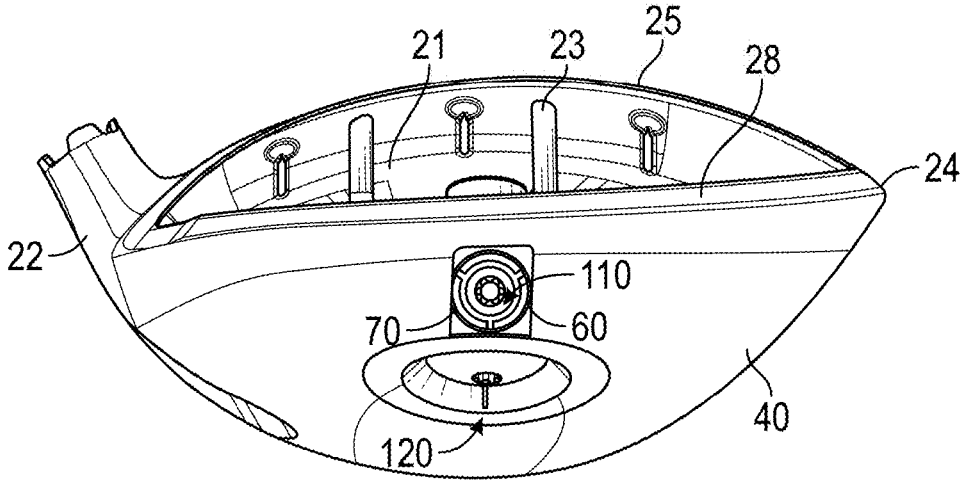
FIG. 5 is a rear elevational view of the embodiment shown in FIG. 2.
Figure 6:
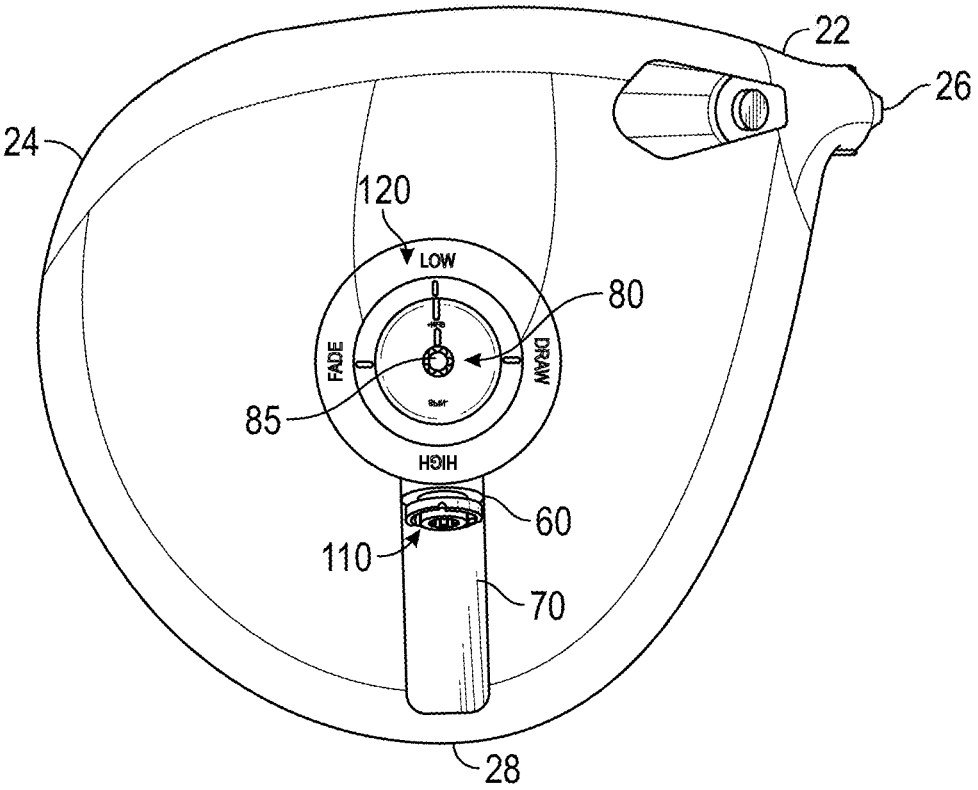
FIG. 6 is a bottom plan view of the embodiment shown in FIG. 2.

The design approaches described herein are based on a driver head construction characterized by a composite crown adhesively bonded to a cast metal alloy (e.g., steel, titanium, aluminum, etc.) body. This particular construction approach permits the crown configuration to be adapted to the inventive weighting scheme with minimal impact on weight and function. However, the weighting embodiments disclosed herein can also be used with other golf club head constructions, including all titanium, all composite, and a composite body with metal face cup. Furthermore, while the Figures illustrate the present invention in connection with a driver, the novel weighting assembly of the present invention can be used with other types of golf club heads, such as fairway woods, hybrids, irons, wedges, and putters, and may also be used with other types of sporting instruments having one or more hollow cavities.

A preferred embodiment of the present invention is shown in FIGS. 1-21. The golf club head 10, which in this embodiment is a driver, comprises a body 20 with a face 21, a heel side 22, a toe side 24, a return portion 25 extending from an upper edge of the face 21, a sole 40 extending from a lower edge of the face 21, a hosel 26 located at the heel side 22, an upper opening 27, and a composite crown 30 that is adhered to the body 20 and covers the upper opening 27. The crown 30 and the body 20 define an interior cavity 35. The golf club head 10 preferably includes, or is compatible with, an adjustable hosel assembly, including any of the embodiments disclosed in U.S. Pat. Nos. 8,002,644, 8,684,859, 8,696,486, 8,715,102, 8,715,103, 8,715,104, 8,727,906, and 8,801,537, and U.S. patent application Ser. No. 14/452,157, the disclosure of each of which is hereby incorporated by reference in its entirety herein. The golf club head 10 also preferably includes one or more face stress reduction features 23 proximate the face 21, as disclosed in U.S. Pat. Nos. 9,486,677, 9,597,558, 9,597,561, 9,687,701, 9,687,702, 9,694,257, 9,757,629, 9,776,058, 9,814,947, 9,821,199, 9,855,476, 9,899,349, 9,908,016, 9,908,017, 9,931,549, and 9,931,550, the disclosure of each of which is hereby incorporated by reference in its entirety herein.

As shown in FIGS. 2-8, a port 50 (also referred to as a socket or pocket) extends into the interior cavity 35 from the sole 40. In alternative embodiments, the port 50 may extend into the interior cavity 35 from the crown 30 or a ribbon portion of the body 20. The port 50 comprises an exterior opening 52 facing the exterior of the body 20, a cylindrical wall 54 approximately extending along a vertical Z axis, and an interior opening 56 in communication with the interior cavity 35. A shallow recess 42 encircles the exterior opening 52 of the port 50. The interior opening 56 has a first width W1 that is less than the width W2 of the exterior opening 52, and is surrounded by a flange 58 that extends at an angle θ with respect to the wall 54. The wall 54 of the port 50 is supported by a plurality of triangular ribs 55*a*, 55*b* extending from the interior surface 41 of the sole 40; these ribs 55*a*, 55*b* reduce the vibration of the port 50 when the golf club head 10 impacts a golf ball. The port 50 connects with a threaded through-bore 60 that faces the rear edge 28 of the body 20. The threaded through-bore 60 communicates with a channel 70 that extends from the rear 28 towards the face 21. The channel 70 provides clearance for a tool (such as a screwdriver or torque wrench, not shown) to access the threaded through-bore 60.

The port 50 is sized to engage with a weight assembly 15 comprising a hollow adjustment sphere 80, a weight arm 100, a fastener 90 connecting the weight arm 100 to the adjustment sphere 80, a friction screw 110, and an adjustment ring 120. These parts of the weight assembly, and how they interact with one another and the golf club body 20, are described in greater detail below and illustrated in FIGS. 2-10 and 13-23.

Figure 14:
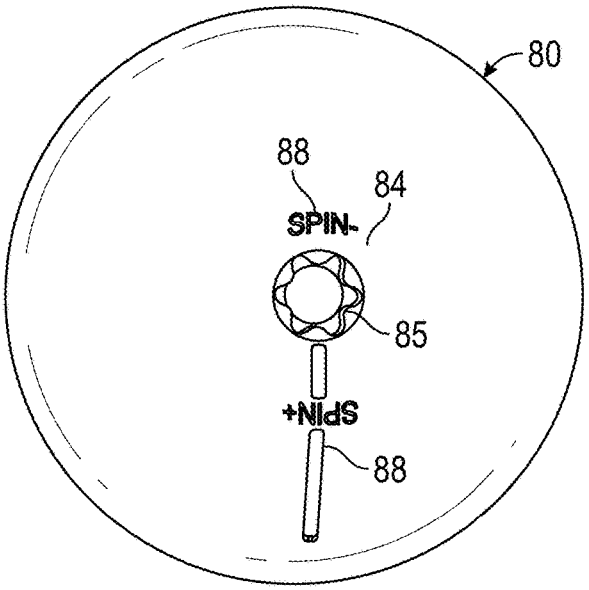
FIG. 14 is a bottom elevational view of the adjustment sphere shown in FIG. 2.
Figure 15:
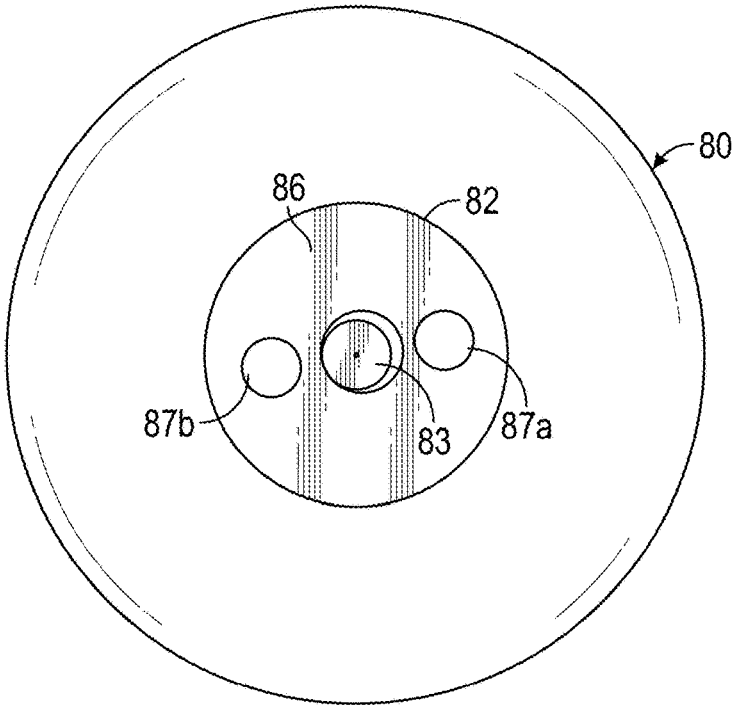
FIG. 15 is a top elevational view of the adjustment sphere shown in FIG. 14.

The adjustment sphere 80 is received within the port 50. The adjustment sphere 80, which is preferably composed of a lightweight, resilient material such as aluminum alloy, composite, or plastic, has a diameter D that is less than W2 (the width of the exterior opening 52) so that the sphere 80 can be placed within the port 50, but greater than W1 (the width of the interior opening 56) so that the sphere 80 does not have the ability to pass completely into the interior cavity 35. The sphere 80 comprises an upper end 82 with a threaded bore 83 sized to receive the threaded portion 92 of a fastener 90 such as a screw or a bolt. The upper end 82 also comprises a shallow recess 86 encircling the threaded bore 83 and locating divots 87*a*, 87*b* in the shallow recess 86, as shown in FIG. 15. The sphere 80 further comprises a lower end 84 directly opposite the upper end 82, as shown in FIG. 14; this lower end 84 includes an unthreaded tool engagement opening 85 sized to receive the tip of a tool such as a screwdriver or torque wrench, and one or more alignment markings 88. The sphere 80 is disposed within the port 50 so that the upper end 82, and the threaded bore 83, faces and extends into the interior cavity 35, as shown in FIGS. 2-4, 7, and 8.

Figure 20:
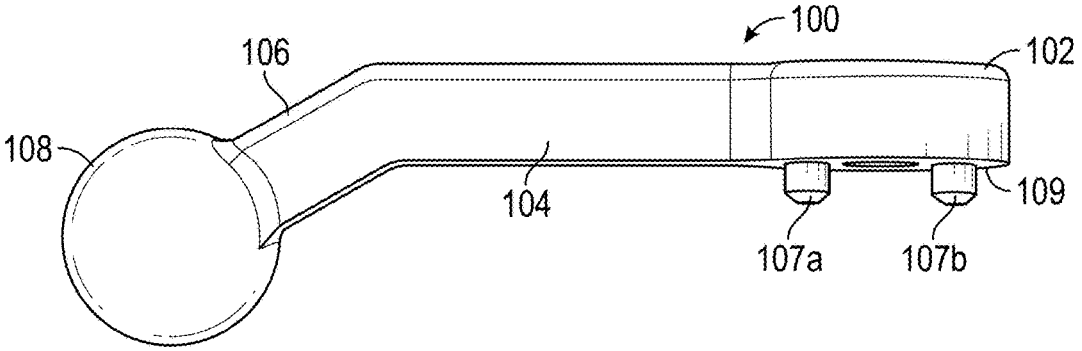
FIG. 20 is a side elevational view of the weight arm shown in FIG. 13.
Figure 21:
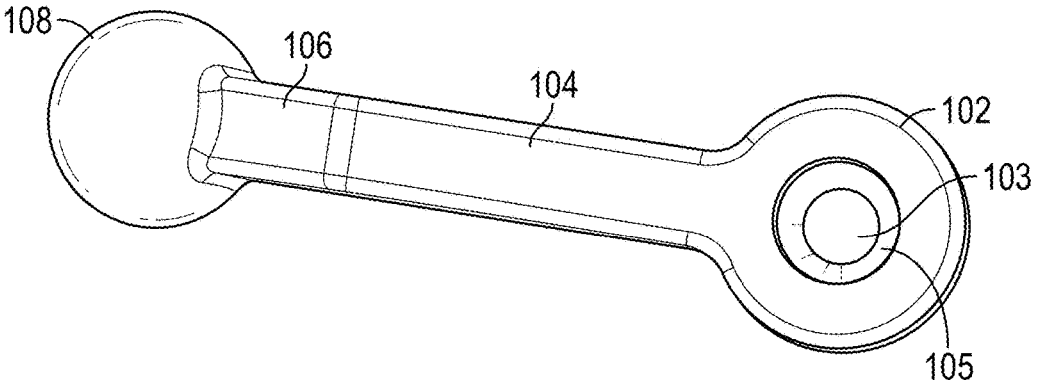
FIG. 21 is a top elevational view of the embodiment shown in FIG. 20.

As shown in the Figures, and particularly FIGS. 20 and 21, the weight arm 100 comprises a first end 102 with a through-opening 103, an elongated midsection 104, and an angled, second end 106 with a weight portion 108 permanently affixed thereto. The weight arm 100 is made of a lightweight, strong material such as plastic, composite, aluminum alloy, steel, or titanium, and preferably is completely hollow or has one or more hollow portions. The weight portion 108 is composed of a denser material, and preferably a tungsten alloy, and preferably does not have any hollow portions. As shown in the Figures, the weight portion 108 is spherical, though in other embodiments may have a different shape. The through-opening 103 is encircled by a flange 105, against which a head portion 94 of the fastener 90 abuts, while the threaded portion 92 of the fastener is allowed to extend entirely through the through-opening 103. A pair of locating pins 107*a*, 107*b* extend from a lower surface 109 of the weight arm at the first end 102, proximate the flange 105. These locating pins 107*a*, 107*b* are sized to fit within the locating divots 87*a*, 87*b* on the upper end 82 of the adjustment sphere 80.

Figure 10:
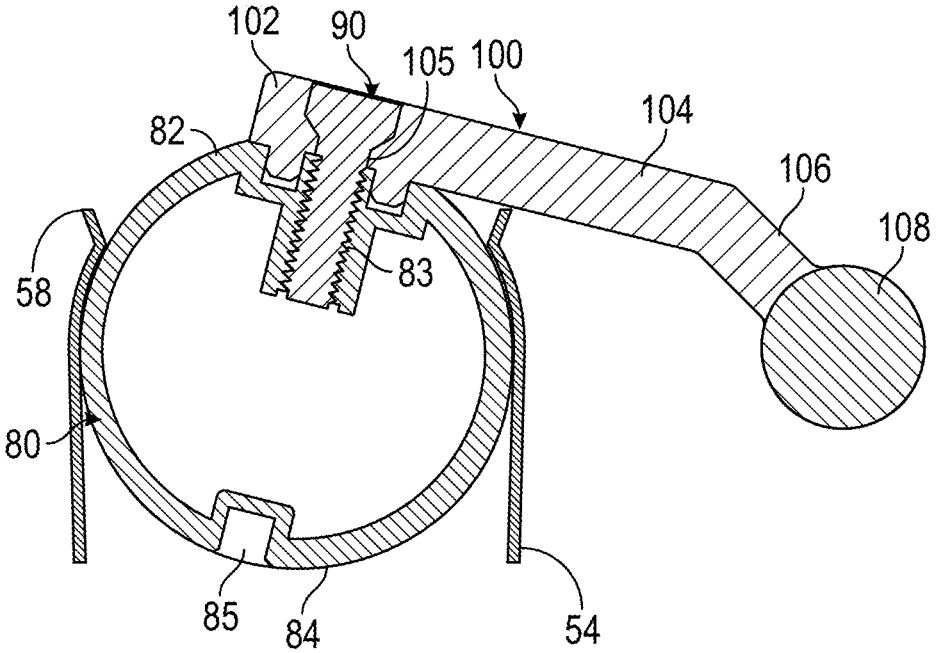
Figure 11:
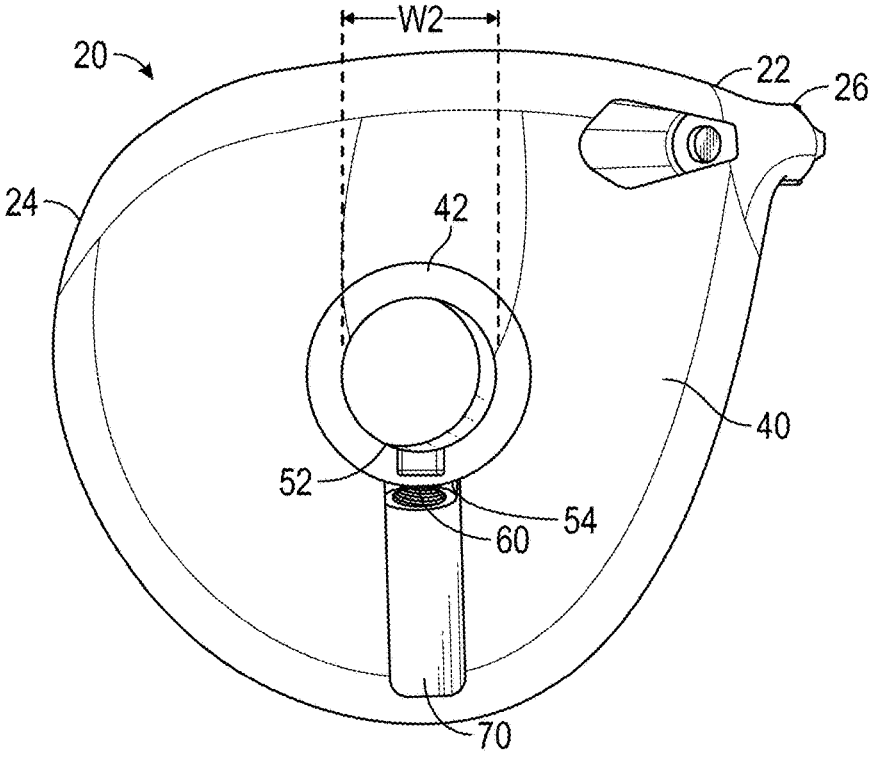
FIG. 11 is a bottom plan view of the embodiment shown in FIG. 2 with the weight assembly removed.
Figure 12:
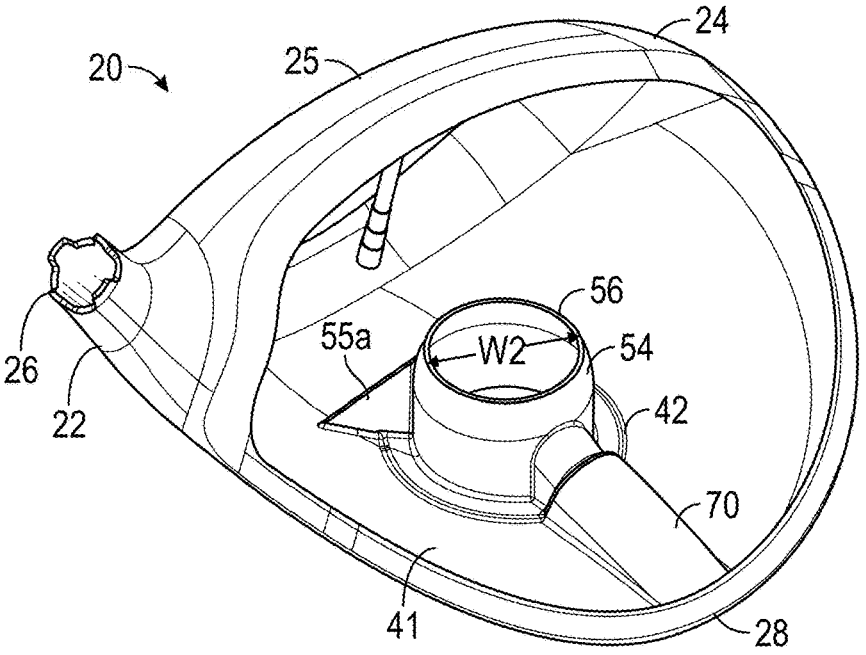
FIG. 12 is a top perspective view of the embodiment shown in FIG. 11.
Figure 16:
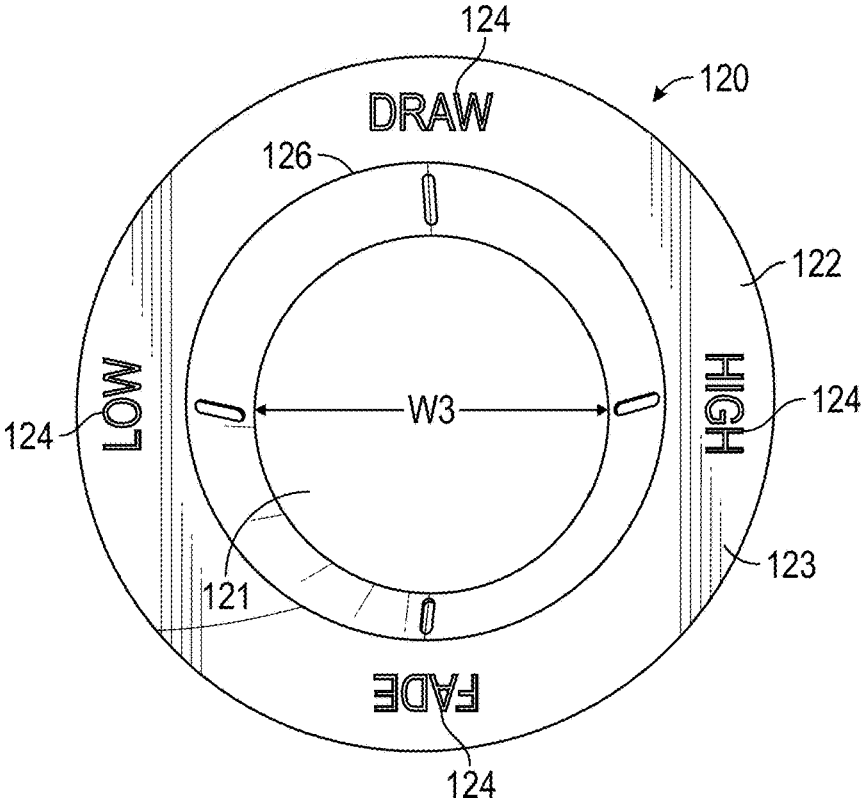
FIG. 16 is a bottom plan view of the adjustment ring shown in FIG. 13.
Figure 17:
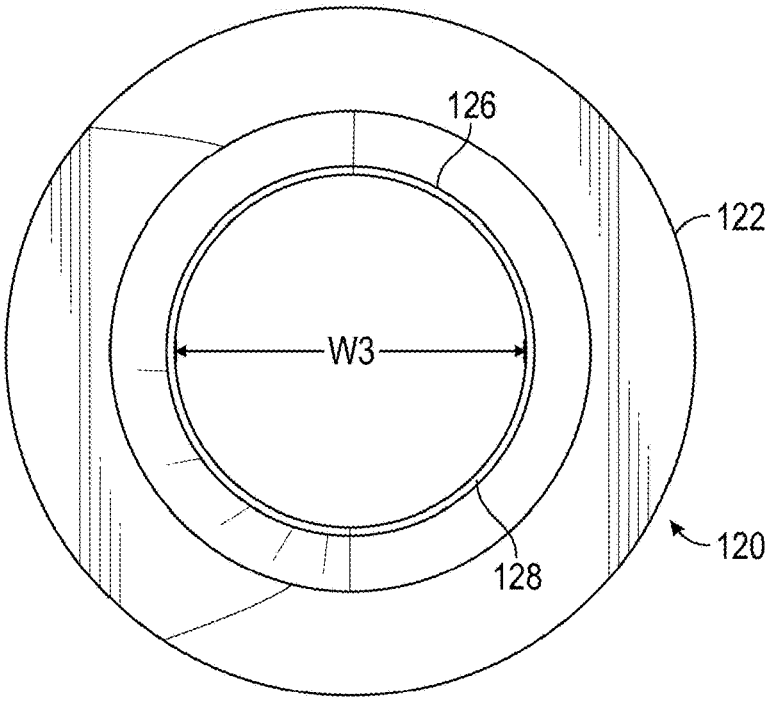
FIG. 17 is a top plan view of the adjustment ring shown in FIG. 16.
Figure 18:
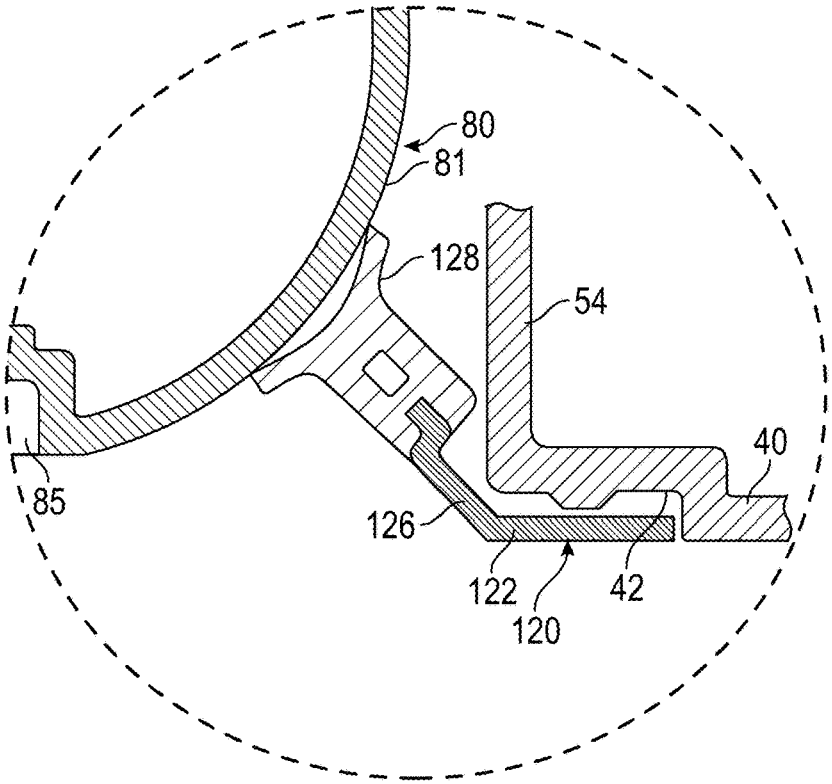
FIG. 18 is an enlarged view of the circled portion of the embodiment shown in FIG. 8.

As shown in FIGS. 16-10, the adjustment ring 120 comprises a cover 122, a conical portion 126, and a gasket 128. The cover 122 has an external surface 123 with a plurality of alignment markings 124, and is connected to the conical portion 126, which extends inwards away from the cover 122. The gasket 128 extends from the end of the conical portion 126. The conical portion 126 and gasket 128 are sized to fit within the exterior opening 52 of the port 50, while the cover 122 covers at least a portion of the port 50. The adjustment ring has a through-opening 121 with a width W3 that is less than the width W2 of the exterior opening 52 and the diameter D of the adjustment sphere 80. The cover 122 and conical portion 126 of the adjustment ring 120 are preferably formed of a rigid, high strength, low density material such as steel, titanium alloy, aluminum alloy, composite, or plastic, while the gasket 128 is preferably composed of an elastomer material such as rubber or plastic, and preferably is over-molded on the end of the conical portion 126.

Once the sphere 80 is placed within the port 50, and before the crown 30 is affixed to the body 20, the first end 102 of the weight arm 100 is placed within the shallow recess 86 of the upper end 82 of the sphere so that the locating pins 107*a*, 107*b* are disposed within the locating divots 87*a*, 87*b*, and the through-opening 103 aligns with the threaded bore 83, as shown in FIGS. 7 and 8. The fastener 90 is then attached to the weight arm 100 and the adjustment sphere 80 so that the threaded portion 92 extends through the through-opening 103 and engages the threads of the threaded bore 83, and the head portion 94 abuts the flange 105, thereby securely affixing the weight arm 100 to the sphere 80. When the weight arm 100 is affixed to the sphere 80 in this way, the midsection 104, second end 106, and weight portion 108 of the weight arm 100 are suspended within the interior cavity 35. Securing the weight arm 100 to the adjustment sphere 80 also prevents the sphere 80 from falling out of the port 50.

Figure 19:
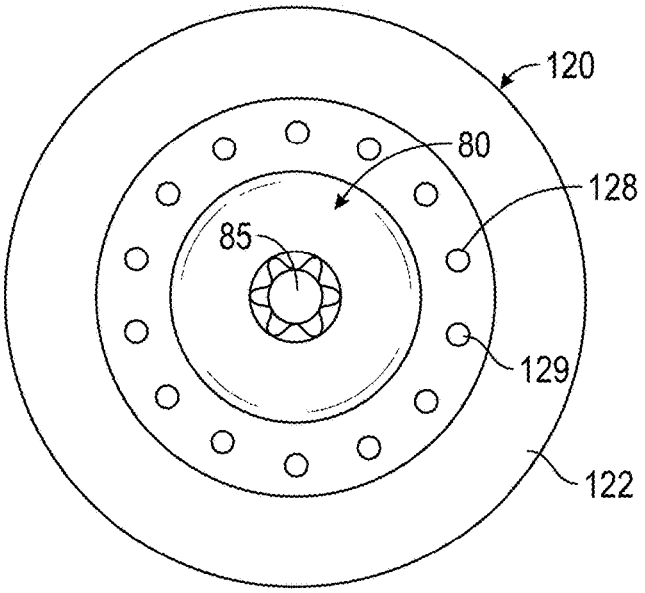
FIG. 19 is a bottom plan view of the embodiment shown in FIG. 13.

After the weight arm 100 is affixed to the adjustment sphere 80, the adjustment ring 120 is attached to the sole 40 so that the cover 122 sits within the shallow recess 42 and the conical portion 126 and gasket 128 extend into the exterior opening 52 of the port 50. The gasket 128, which may include flexure-enhancing divots 129 as shown in FIG. 19, rests against the outer surface 81 of the adjustment sphere 80, the lower end 84 of which is visible through the through-opening of the adjustment ring 120, and creates some friction with the sphere 80 so as to prevent it from sliding too much during adjustment by a user. The adjustment ring 120 preferably is permanently bonded to the sole 40 so that it does not disengage from the golf club head 10 during use. The alignment markings 124 on the adjustment ring 120 provide guidance for the user to adjust the weight assembly 15, while the cover 122, conical portion 126, and gasket 128 prevent debris from entering the port 50 and interfering with the function of the weight assembly 15 or rattling around in the interior cavity 35.

Figure 9:
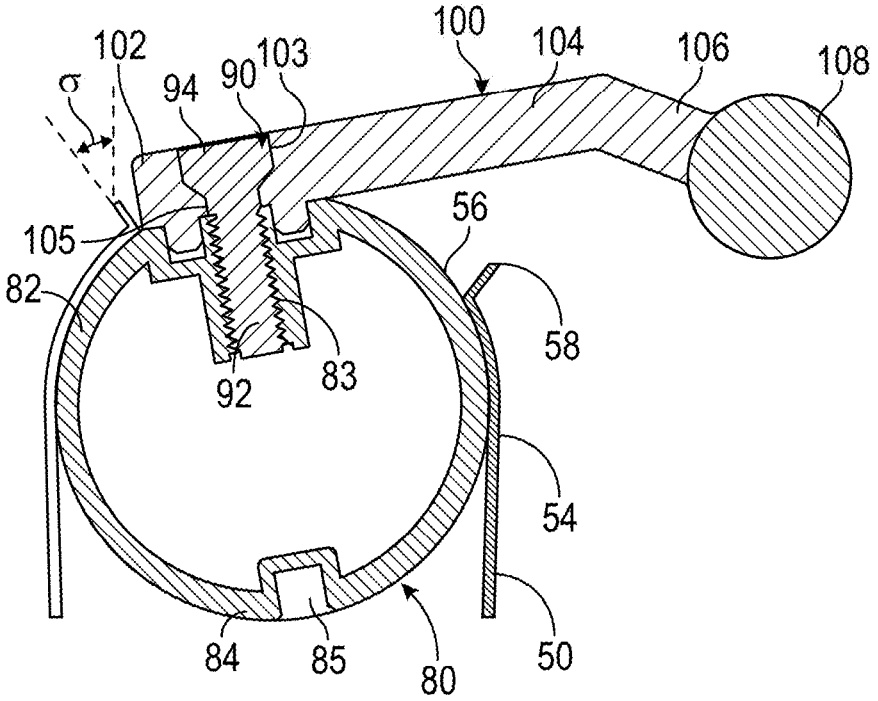
FIGS. 9 and 10 are cross-sectional views of the weight assembly and port shown in FIG. 7

When the adjustment sphere 80, weight arm 100, and adjustment ring 120 are assembled as described above, a golfer can adjust the position of the weight arm 100 within the interior cavity 35 by inserting a tool into the tool engagement opening 85 of the adjustment sphere and rotating the sphere 80. In alternative embodiments, the sphere 80 may lack a tool engagement opening 85 and instead have other features that enable a golfer to rotate the sphere 80, such as one or more ridges. The alignment markings 88, 124 on the sphere 80 and the adjustment ring 120 provide guidance for the golfer so they know how to change the bias of the golf club head 10. As shown in FIGS. 9 and 10, the angled flange 58 of the port 50 controls the range within which the weight arm 100 can move, which prevents the weight portion 108 (or other sections of the weight arm 100) from contacting other portions of the golf club head 10, such as the sole 40, face 21, and crown 30. In other words, the flange 58 sets height and angle limits for the weight arm 100 by abutting the weight arm 100 when it is moved too far in one direction within the interior cavity 35.

Figure 13:
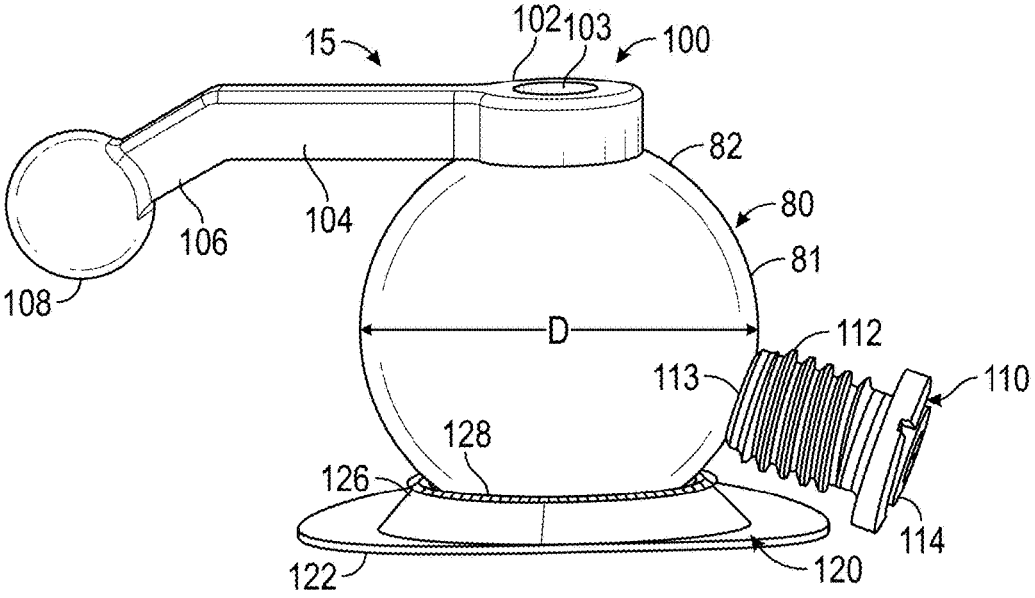
FIG. 13 is a side elevational view of the weight assembly shown in FIG. 2.

Once the golfer has moved the weight arm 100 to a desired orientation, they insert the threaded portion 112 of the friction screw 110 into the threaded through-bore 60 and use a tool to tighten the friction screw 110 until its head 114 presses against the outer surface of the port 50 wall 54 and the end 113 threaded portion 112 presses against the outer surface 81 of the sphere 80, as shown in FIGS. 7 and 13. This pressure temporary immobilizes the sphere 80 within the port 50 and thereby prevents the weight arm 100 from moving within the interior cavity. If the golfer wishes to readjust the weight arm 100, they can loosen the friction screw 110 until the sphere 80 is mobile again and make further adjustments. The same tool (torque wrench or screwdriver) that is used to engage the tool engagement opening 85 of the adjustment sphere 80 can be used to tighten or loosen the friction screw 110 within the threaded through-bore 60.

Figure 24:
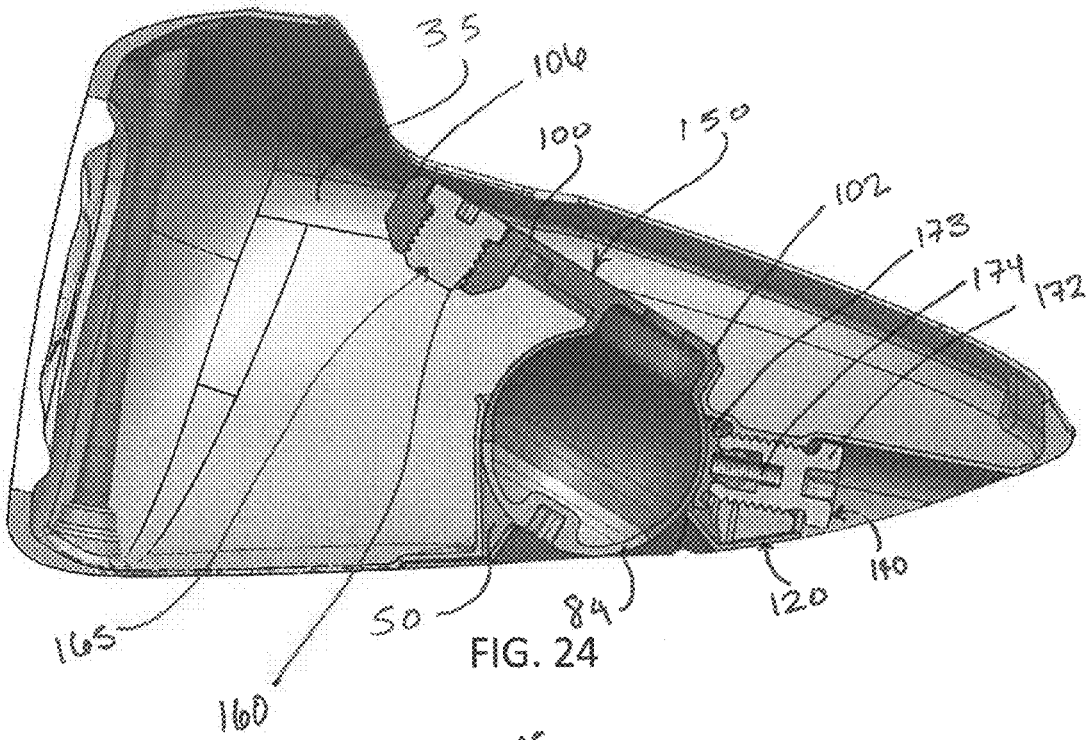
FIG. 24 is a cross-sectional view of another alternative embodiment of the present invention.
Figure 25:
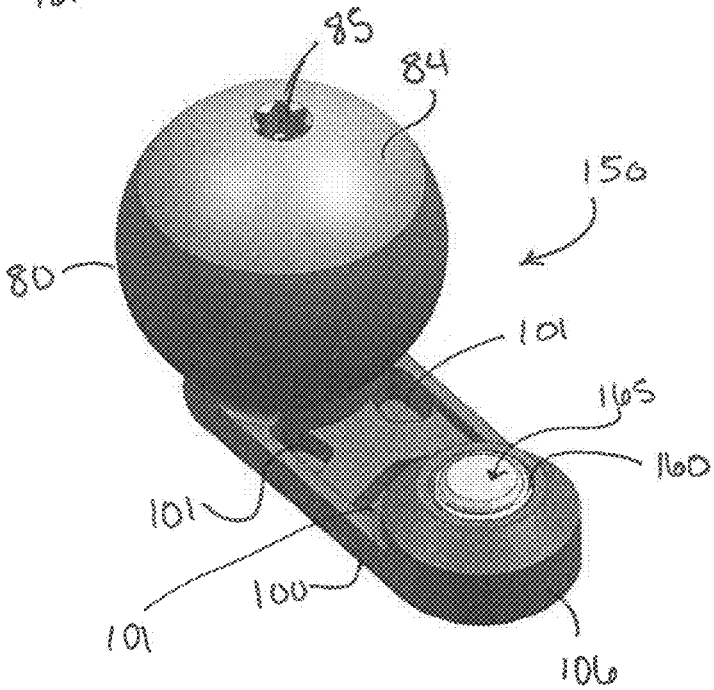
FIG. 25 is a top perspective view of the weight assembly shown in FIG. 24.
Figure 26:
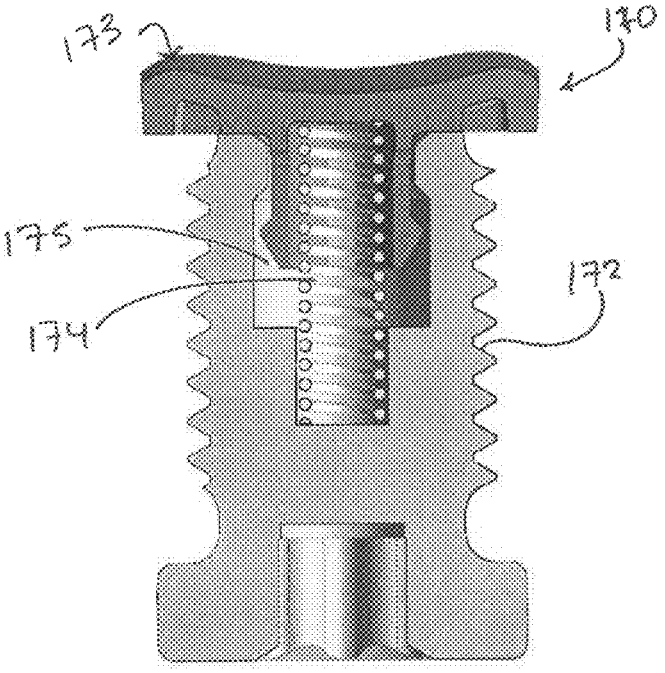
FIG. 26 is an enlarged view of the spring loaded set screw shown in FIG. 24.

In an alternative embodiment, shown in FIGS. 24-26, portions of the sphere 80 and weight arm 100 portions of the weight assembly 150 are integrally formed. In this embodiment, the upper end 82 of the sphere 80 and the weight arm 100 are integrally formed from a titanium alloy material, and the lower end 84 is formed separately, preferably from a metal alloy having a different density than the alloy from which the integrally formed portion is composed, and then welded to the upper end 82. This multi-material structure allows weight to be disposed lower on the weight assembly 150.

In this embodiment, instead of a weight portion 108, the weight arm 100 has a second end 106 through-opening 160 sized to receive a weight screw 165 that can be removed and replaced with a weight screw 165 having a different density, which can allow for further adjustment of the mass properties of the golf club head 10. The weight arm 100 also comprises a plurality of shallow regions 101, which further optimize the weight distribution across the weight assembly 150.

This embodiment also employs a spring-loaded set screw 170, which accommodates for roundness issues in the sphere 80; the rotation of the sphere 80 feels smoother with a spring-loaded set screw 170 than with a standard friction screw 110. In this embodiment, set screw 170 comprises a screw portion 172, a separately formed tip end 173 that has a snap fit design within the screw portion 172, and a spring 174 trapped in a cavity 175 between the tip end 173 and the screw portion 172. The tip end 173 of the set screw 170, which presses against the adjustment sphere 80, has a square profiled shape, which prevents circular wear patterns from forming on the sphere 80. Instead, the wear gets pushed to the interface between the screw portion 172 and the tip end 173.

Figure 22:
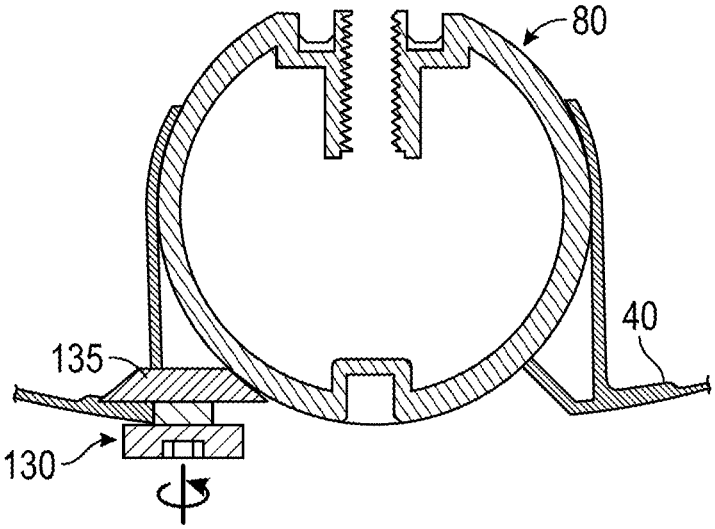
FIGS. 22 and 23 are cross-sectional views of alternative embodiments of the present invention.
Figure 23:
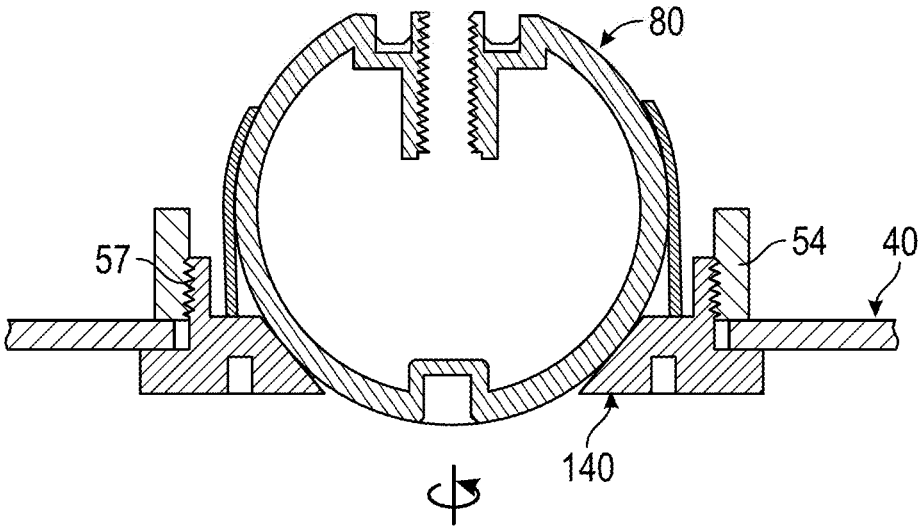

Alternative structures designed to place pressure or load on the sphere 80, and thereby temporarily immobilize it within the port 50, are shown in FIGS. 22 and 23. For example, in FIG. 22, a cam 130 has a head 135 that extends into the interior cavity 35 and through the wall 54 of the port 50 and can be rotated by a tool to place load on the sphere 80. As with the preferred embodiment, a single tool can be used to adjust the sphere 80 and the cam 130. In the embodiment shown in FIG. 23, the adjustment ring 120 is replaced with a threaded cap 140. The wall 54 of the port 50 in this embodiment has a threaded lower portion 57 that engages with the threads of the threaded cap 140, which can be tightened within the port 50 to immobilize the sphere 80 within the port 50.

In any of the embodiments disclosed herein, the wall 54 of the port 50 preferably is at least partially, and more preferably completely, coated with a high friction coating to reduce slippage of the sphere 80 when the weight assemblies 15, 150 are fully engaged with the golf club head 10.

The weight assemblies 15, 150 of the present invention allow a user to fluidly adjust the center of gravity of the golf club head 10 along the x, y, and z axes to create different shot shapes and spin characteristics, without being constrained to a limited number of adjustment locations. This provides golfers of all skill levels with the ability to adjust their club to their swing, and then change the center of gravity of the club as their swing improves.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a body comprising a face portion, a sole, a crown, a heel side, a toe side, a rear side, a port, and an interior cavity;

an adjustment sphere comprising an upper end and a lower end opposite the upper end;

a weight arm comprising a first end, a midsection, and a second end having a weight portion;

an adjustment ring having a cover and a through-opening; and a retention device capable of extending into the port, wherein the port comprises a port wall, an interior opening having a first width in communication with the interior cavity, and an exterior opening having a second width that is greater than the first width, wherein the adjustment sphere is at least partially disposed within the port so that the upper end is exposed to the interior cavity through the interior opening and the lower end is visible through the exterior opening, wherein the adjustment sphere has a diameter that is greater than the first width and less than the second width, wherein the adjustment ring is affixed to the sole so that a portion of the adjustment ring extends over the exterior opening of the port and the lower end of the adjustment sphere is visible through the through-opening, wherein the first end of the weight arm is affixed to the upper end of the adjustment sphere, wherein at least the second end of the weight arm is suspended within the interior cavity and does not make direct contact with the body, wherein moving the adjustment sphere within the port causes the weight arm to move within the interior cavity and thereby change at least one of a moment of inertia and a location of a center of gravity of the golf club head, and wherein engaging the retention device reversibly immobilizes the adjustment sphere within the port.

2. The golf club head of claim 1, wherein the adjustment ring further comprises a conical portion and a gasket, wherein the conical portion extends from the cover into the port, and wherein the gasket is attached to an edge of the cover and contacts the adjustment sphere.

3. The golf club head of claim 1, wherein each of the lower end of the adjustment sphere and an outer surface of the cover comprises at least one alignment marking.

4. The golf club head of claim 1, wherein the weight portion is composed of a first material having a first density, and wherein at least one of the first end and midsection of the weight arm is composed of a second material having a second density that is less than the first density.

5. The golf club head of claim 4, wherein the first material is a tungsten alloy.

6. The golf club head of claim 4, wherein the second material is selected from the group consisting of composite, plastic, aluminum alloy, and steel.

7. The golf club head of claim 4, wherein the weight portion is spherical.

8. The golf club head of claim 1, wherein the adjustment sphere is hollow and is composed of a material selected from the group consisting of composite, plastic, aluminum alloy, and steel.

9. The golf club head of claim 1, wherein at least one of the first end and midsection of the weight arm has a hollow portion.

10. The golf club head of claim 1, further comprising a threaded through-bore extending through the port wall, wherein the threaded through-bore is accessible from outside of the body, wherein the retention device is a friction screw having a second threaded portion sized to mate with threads of the threaded through-bore, and wherein tightening the friction screw within the threaded through-bore causes the second threaded portion to press against the adjustment sphere.

11. The golf club head of claim 1, wherein the lower end of the adjustment sphere comprises a tool engagement opening.

12. The golf club head of claim 1, wherein the retention device is selected from the group consisting of a friction screw, a cam assembly, and a threaded cap.

13. The golf club head of claim 1, further comprising at least one rib, wherein the port is disposed in the sole, and wherein the at least one rib extends between an interior surface of the sole and the port wall.

14. The golf club head of claim 1, wherein the port further comprises a port flange surrounding the interior opening, and wherein the port flange extends at an angle with respect to the port wall.

15. A golf club head comprising:

a metal body comprising a face, a return portion extending from an upper edge of the face, a sole extending from a lower edge of the face, a port extending from the sole into an interior cavity, a sole channel, and an upper opening;

a non-metal crown affixed to the body to cover the upper opening and enclose the interior cavity;

a weight assembly comprising:

a hollow adjustment sphere comprising an upper end and a lower end opposite the upper end having at least one tool engagement feature;

a weight arm comprising a first end affixed to the upper end of the hollow adjustment sphere, an elongated midsection, and a second end comprising a weight portion; and a screw comprising a threaded portion, wherein the port comprises a wall, an interior opening with a first width in communication with the interior cavity, a port flange surrounding the interior opening, an exterior opening with a second width that is greater than the first width, and a threaded through-bore that extends through the wall and communicates with the sole channel, wherein the port flange extends at an angle with respect to the port wall, wherein the hollow adjustment sphere is disposed within the port so that the upper end is exposed to the interior cavity through the interior opening and the lower end is visible through the exterior opening, wherein the midsection and the second end of the weight arm are suspended within the interior cavity, wherein the weight arm is integrally formed with the upper end of the hollow adjustment sphere, wherein the threaded portion of the screw extends through the through-bore and into the port, wherein moving the hollow adjustment sphere within the port causes the weight arm to move within the interior cavity and thereby change at least one of a moment of inertia and a location of a center of gravity of the golf club head, and wherein tightening the screw causes the second threaded portion to press against the hollow adjustment sphere and reversibly immobilize the hollow adjustment sphere within the port.

16. The golf club head of claim 15, wherein the sole channel extends from a rear edge of the body towards the port.

17. The golf club head of claim 15, wherein the weight portion is composed of a tungsten alloy, and wherein at least one of the first end and midsection of the weight arm is composed of a material selected from the group consisting of composite, plastic, aluminum alloy, and steel.

18. The golf club head of claim 15, wherein the golf club head is selected from the group consisting of a driver-type head, a fairway wood-type head, and a hybrid-type head.

* * * * *